US009903626B2

(12) United States Patent
Sibik et al.

(10) Patent No.: US 9,903,626 B2
(45) Date of Patent: Feb. 27, 2018

(54) FLUID MANAGEMENT IN A HVAC SYSTEM

(71) Applicant: TRANE INTERNATIONAL INC., Davidson, NC (US)

(72) Inventors: Lee L. Sibik, Onalaska, WI (US); Benjamin E. Dingel, La Crosse, WI (US); Harry Kenneth Ring, Houston, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 4 days.

(21) Appl. No.: 15/383,291

(22) Filed: Dec. 19, 2016

(65) Prior Publication Data

US 2017/0097182 A1 Apr. 6, 2017

Related U.S. Application Data

(63) Continuation of application No. 14/055,484, filed on Oct. 16, 2013, now Pat. No. 9,523,523.
(Continued)

(51) Int. Cl.
*F25B 49/02* (2006.01)
*F25B 45/00* (2006.01)
(Continued)

(52) U.S. Cl.
CPC ..... *F25B 49/02* (2013.01); *F25B 31/004* (2013.01); *F25B 39/00* (2013.01); *F25B 40/00* (2013.01);
(Continued)

(58) Field of Classification Search
CPC ..... F25B 49/02; F25B 31/004; F25B 39/00; F25B 2339/024; F25B 2339/0242; F25B 2600/2515; F25B 2700/04
See application file for complete search history.

(56) References Cited

U.S. PATENT DOCUMENTS 3,286,482 A 11/1966 Clark et al.
4,123,919 A 11/1978 Fehlhaber
(Continued)

FOREIGN PATENT DOCUMENTS

CN 101443605 A 5/2009
CN 201583040 U 9/2010
(Continued)

OTHER PUBLICATIONS

International Search Report for PCT/US2013/065269 dated Jan. 24, 2014, 3 pages.
(Continued)

*Primary Examiner* — Dominick L Plakkoottam
*Assistant Examiner* — Raheena R Malik
(74) *Attorney, Agent, or Firm* — Hamre, Schumann, Mueller & Larson, P.C.

(57) ABSTRACT

A spill over tank for an evaporator of a HVAC system may be configured to receive a refrigerant spilled over from the evaporator. The spill over tank may be configured to have an outlet that directs the refrigerant in the spill over tank out of the spill over tank. The refrigerant may flow through the outlet back to a compressor of the HVAC system. The spill over tank may be equipped with a refrigerant level sensor configured to measure a refrigerant level in the spill over tank. The measured refrigerant level in the spill over tank may be used to control and/or maintain a refrigerant level in the evaporator, and/or may be used to control a return refrigerant flow into the compressor of the HVAC system so as to manage an oil return to the compressor.

17 Claims, 5 Drawing Sheets

Related U.S. Application Data

(60) Provisional application No. 61/714,462, filed on Oct. 16, 2012.

(51) Int. Cl.

| | |
|---|---|
| ***F25B 31/00*** | (2006.01) |
| ***F25B 40/00*** | (2006.01) |
| ***F25B 39/00*** | (2006.01) |
| *F25B 39/02* | (2006.01) |

(52) U.S. Cl.

CPC ..... *F25B 45/00* (2013.01); *F25B 39/02* (2013.01); *F25B 2339/024* (2013.01); *F25B 2339/0242* (2013.01); *F25B 2339/046* (2013.01); *F25B 2400/16* (2013.01); *F25B 2600/2513* (2013.01); *F25B 2600/2515* (2013.01); *F25B 2700/04* (2013.01); *Y10T 137/5762* (2015.04)

(56) References Cited

U.S. PATENT DOCUMENTS

| | | | | |
|---|---|---|---|---|
| 4,187,695 | A | 2/1980 | Schumacher | |
| 4,291,544 | A | 9/1981 | Larsen | |
| 4,429,544 | A | 2/1984 | McCarty | |
| 4,474,030 | A | 10/1984 | Ladusaw | |
| 5,209,080 | A * | 5/1993 | Zinsmeyer | F16K 31/30 137/433 |
| 5,396,776 | A | 3/1995 | Kim | |
| 5,539,382 | A * | 7/1996 | Duff | F25B 49/027 165/11.1 |
| 5,539,385 | A * | 7/1996 | Duff | F25B 49/005 165/11.1 |
| 5,542,261 | A * | 8/1996 | Albertson | F25B 1/053 62/149 |
| 5,546,073 | A * | 8/1996 | Duff | G05B 23/0235 165/11.1 |
| 5,638,691 | A | 6/1997 | Hartfield et al. | |
| 5,677,677 | A * | 10/1997 | Duff | F25B 49/005 165/11.1 |
| 6,202,437 | B1 | 3/2001 | Yun | |
| 6,253,562 | B1 * | 7/2001 | Bujak, Jr. | F25B 40/02 62/206 |
| 6,467,300 | B1 | 10/2002 | Noble, III | |
| 6,868,695 | B1 * | 3/2005 | Dingel | F25B 39/028 165/115 |
| 2006/0075763 | A1 * | 4/2006 | Park | F25B 43/006 62/149 |
| 2008/0210601 | A1 * | 9/2008 | Shoulders | F25B 31/004 208/184 |
| 2010/0071398 | A1 * | 3/2010 | Hipp-Kalthoff | B60H 1/3233 62/285 |

FOREIGN PATENT DOCUMENTS

| | | |
|---|---|---|
| CN | 201811490 U | 4/2011 |
| JP | 4-340059 | 11/1992 |
| JP | 5-322330 | 12/1993 |
| JP | 06272977 | 9/1994 |
| JP | H085204 A | 1/1996 |
| JP | 2012-163299 | 8/2012 |
| WO | WO01/40659 A1 | 6/2001 |

OTHER PUBLICATIONS

Written Opinion for PCT/US2013/065269 dated Jan. 24, 2014, 6 pages.

* cited by examiner

FLUID MANAGEMENT IN A HVAC SYSTEM

FIELD

The disclosure herein relates to heating, ventilation, and air-conditioning ("HVAC") systems, and more particularly to evaporators and compressors used in HVAC systems. Generally, methods, systems, and apparatuses are described that are directed to fluid (such as refrigerant and/or oil) management in an evaporator and/or a compressor such as may be used in HVAC chillers.

BACKGROUND

A HVAC system typically includes a compressor, a condenser, an evaporator and an expansion device forming a refrigeration circuit. Flooded and falling-film evaporators generally are known and often have a construction of a tube bundle within a shell. Such evaporators are typically used in HVAC chillers to cool a process fluid (e.g., water) flowing in the tube bundle which, in turn, is typically used in connection with a heat exchanger coil or air-handling unit to cool air moving through the coil or air-handling unit. The tube bundle is often stacked up from a bottom of the evaporator. In a flooded evaporator, ideally, the tube bundle is covered with refrigerant in the shell to help maximize heat exchange between the refrigerant and the processed fluid. A fluid level of the refrigerant in the evaporators may be controlled by an expansion device.

The compressor of the HVAC system often requires lubricating oil to lubricate moving parts of the compressor. In the HVAC system, the oil may circulate in the refrigeration circuit along with the refrigerant, and then return to the compressor. The HVAC system often incorporates methods and systems for managing the fluids, such as refrigerant and/or oil.

SUMMARY

Improving fluid management in a HVAC system can help increase efficiency of the HVAC system. The fluid management as described herein generally includes refrigerant level management in an evaporator of the HVAC system, as well as return oil management in a compressor of the HVAC system by incorporating a spill over tank. Embodiments disclosed herein may help improve the refrigerant level management, such as maintaining a desired refrigerant level in the evaporator of the HVAC system. Embodiments disclosed herein may also help improve lubricant (such as for example oil) return management to a compressor of the HVAC system, which may help achieve a proper lubrication in the compressor of the HVAC system.

In some embodiments, a system may include a spill over tank with a reservoir configured to receive refrigerant spilled out of an evaporator. The spill over tank may also include an outlet allowing the refrigerant collected in the spill over tank to flow out of the spill over tank. When the evaporator has an operational refrigerant level, the spill over tank can have a corresponding spill over refrigerant level.

In some embodiments, the spill over tank may include a fluid level sensor configured to measure the spill over refrigerant level in the spill over tank. The spill over refrigerant level measured by the fluid level sensor can be used to control and/or maintain the operational refrigerant level in the evaporator, and/or control the oil return to the compressor of the HVAC system.

In some embodiments, the refrigerant flowing out of the spill over tank may include an oil portion, which may be directed back to a compressor. In some embodiments, the refrigerant flowing out of the spill over tank may be directed into a heat exchanger that is configured to vaporize some or most of the refrigerant portion by exchanging heat between the refrigerant flowing out of the spill over tank and a heat source, so that a liquid flowing back to the compressor may be primarily the oil portion because the oil generally is more difficult to vaporize compared to the refrigerant. In some embodiments, the heat source may be refrigerant directed out of a condenser. In some embodiments, the heat source may be other process fluids or a heating element.

In some embodiments, the spill over tank may be equipped with a fluid flow regulating device at an outlet of the spill over tank. In some embodiments, the fluid flow regulating device may be a flow regulating valve. In some embodiments, the fluid flow regulating device may be a standpipe positioned upstream of the outlet of the spill over tank. In some embodiments, the standpipe may have a plurality of openings distributed along a height of the standpipe, where the plurality of openings may be configured to meter a fluid to flow to the outlet.

In some embodiments, a method of managing an operational refrigerant level in the evaporator may include determining a spill over refrigerant level setpoint in the spill over tank corresponding to the operational refrigerant level based on an association of the operational refrigerant level in the evaporator and the spill over refrigerant level in the spill over tank; measuring the spill over refrigerant level in the spill over tank; and comparing the spill over refrigerant level in the spill over tank and the spill over refrigerant level setpoint. In some embodiments, the method may also include when the spill over refrigerant level in the spill over tank is higher than the spill over refrigerant level setpoint, decreasing a refrigerant charge to the evaporator; when the spill over refrigerant level in the spill over tank is lower than the spill over refrigerant level setpoint, increasing the refrigerant charge to the evaporator; and when the spill over refrigerant level in the spill over tank is about the same as the spill over refrigerant level setpoint, maintaining the refrigerant charge to the evaporator.

In some embodiments, a method of managing an oil return to the compressor of the HVAC system may include determining a return refrigerant flow rate to the compressor; determining a refrigerant level required to achieve the return refrigerant flow rate through a metering device in a spill over tank; measuring a refrigerant level in the spill over tank; and comparing the measured refrigerant level in the spill over tank with the required refrigerant level. In some embodiments, the method may include when the measured refrigerant level in the spill over tank is lower than the required refrigerant level, increasing a refrigerant charge to the evaporator; when the measured refrigerant level in the spill over tank is higher than the required refrigerant level, decreasing the refrigerant charge to the evaporator; and when the measured refrigerant level in the spill over tank is about the same as the required refrigerant level, maintaining the refrigerant charge to the evaporator.

In some embodiments, a method of managing a fluid in a HVAC system may include: directing a portion of refrigerant out of an evaporator of a HVAC system, where a flow rate of the refrigerant directed out of the evaporator has an association with an operational refrigerant level in the evaporator; measuring the flow rate of the refrigerant directed out of the evaporator; and comparing the measured flow rate of the refrigerant directed out of the evaporator with a pre-determined flow rate setpoint. In some embodiments, the method may also include when the measured flow rate is lower than the pre-determined flow rate setpoint, increasing a refrigerant charge to the evaporator; when the flow rate is higher than the pre-determined flow rate setpoint, decreasing the refrigerant charge to the evaporator; and when the flow rate is about the same as the pre-determined flow rate setpoint, maintaining the refrigerant charge to the evaporator.

In some embodiments, the method of managing a fluid in a HVAC system may include determining a desired operational refrigerant level in the evaporator; and determining a flow rate setpoint associated with the desired operational refrigerant level in the evaporator based on the association between the flow rate of the refrigerant directed out of the evaporator and the refrigerant level in the evaporator. In some embodiments, the method may include collecting the refrigerant directed out of the evaporator in a collection device; directing the refrigerant collected in the collection device out of the collection device; and measuring a fluid level of the refrigerant collected in the collecting device.

In some embodiments, the method of managing an oil return in a HVAC system may include determining a flow rate setpoint based on an operational requirement of a compressor of the HVAC system.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A is a schematic diagram of the HVAC system including the spill over tank. FIG. 1B is a side view of an evaporator of the HVAC system including the spill over tank.

FIG. 2A illustrates a spill over tank that includes a fluid control valve. FIG. 2B illustrates a spill over tank that includes a standpipe as a metering device.

DETAILED DESCRIPTION

Figure 1A:
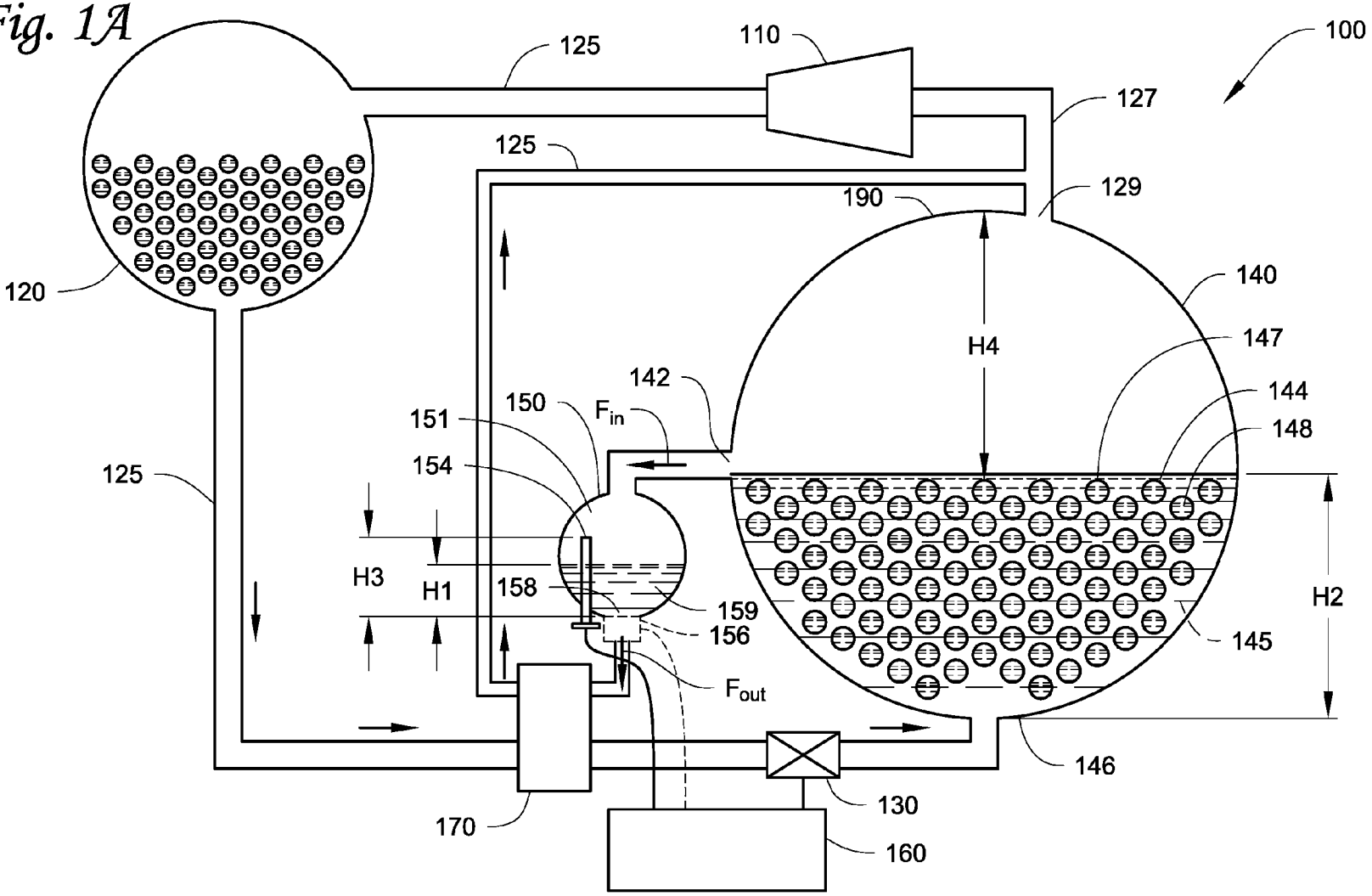
FIGS. 1A and 1B illustrate an embodiment of a HVAC system including a spill over tank.

In a HVAC system, a fluid, such as lubricating oil and/or refrigerant may mix in a refrigerant circuit that is typically formed by a compressor, a condenser, an evaporator and an expansion device. The HVAC system may incorporate methods and systems to manage the fluids, such as the refrigerant and the oil.

In a flooded evaporator, for example, it may be desirable to wet all heat exchange tubes of a tube bundle with refrigerant in a shell of the evaporator. Overcharging the evaporator with excessive refrigerant may cause refrigerant waste; while undercharging the evaporator may cause a portion of the tube bundle to not to be wetted by the refrigerant resulting in a reduction of heat exchange efficiency. The refrigerant level within the evaporator can be typically regulated by opening up the expansion device to increase a refrigerant charge to the evaporator or closing down the expansion device to decrease refrigerant charge to the evaporator. In some evaporators, a fluid level sensor is positioned inside the shell of the evaporator to measure a refrigerant level in the evaporator, and the expansion device can be controlled to regulate the refrigerant level inside the evaporators based on the measured refrigerant level. However, at least due to, for example, boiling of the refrigerant inside the evaporator, it can be difficult to measure the refrigerant level accurately with the refrigerant level sensor positioned inside the evaporator, causing difficulties in accurately managing the refrigerant level in the evaporator. Improving refrigerant level management in the evaporator can help increase the efficiency of the evaporator.

The oil lubricating the compressor may circulate in the refrigerant circuit along with the refrigerant. Proper oil return to the compressor may be required for proper lubrication of the compressor when the compressor is in operation. Managing the oil return to the compressor may help maintain a proper oil level in a suction line supplying the oil to the compressor, and/or help maintain an acceptable oil content in the refrigerant in the evaporator.

In the following description, systems and methods to manage fluids, such as oil and/or refrigerant, in a HVAC system are described. In some embodiments, a system to manage fluids may include a spill over tank configured to receive refrigerant spilled out from an evaporator. The spill over tank may include a fluid level sensor configured to measure a spill over refrigerant level inside the spill over tank. The spill over tank may also have a fluid outlet configured to allow the refrigerant received in the spill over tank to flow out of the spill over tank and circulate back to a suction line supplying the oil to the compressor. In some embodiments, a method to manage a refrigerant level in an evaporator of a HVAC system may include controlling an expansion device of the HVAC system so that a spill over refrigerant level in the spill over tank measured by the fluid level sensor may be maintained at a pre-determined spill over refrigerant level setpoint. In some embodiments, a method to manage an oil return to a compressor may include controlling the refrigerant level in the spill over tank measured by the fluid level sensor so as to control a flow rate for the refrigerant flowing out of the spill over tank, which in turn may affect the oil return rate from the evaporator and/or a concentration of oil within the evaporator in the HVAC system.

References are made to the accompanying drawings that form a part hereof, and in which is shown by way of illustration of the embodiments in which the embodiments may be practiced. The phrases "upstream" and "downstream" are referred relatively to a flow direction. Fluids such as refrigerant or oil, may also contain other compositions. For example, refrigerant may contain oil. The term "fluid" is a general term that can be referred to oil, refrigerant, other liquid, or the mixture of thereof. The term "about the same" generally is referring to a condition that a regulated value falls within a desired range of a target value. When the regulated value falls within the desired range, the performance of, for example, an evaporator of a HVAC system may not have substantial difference with the performance at the target value. It is to be understood that the terms used herein are for the purpose of describing the figures and embodiments and should not be regarded as limiting the scope of the present application.

Figure 1B:
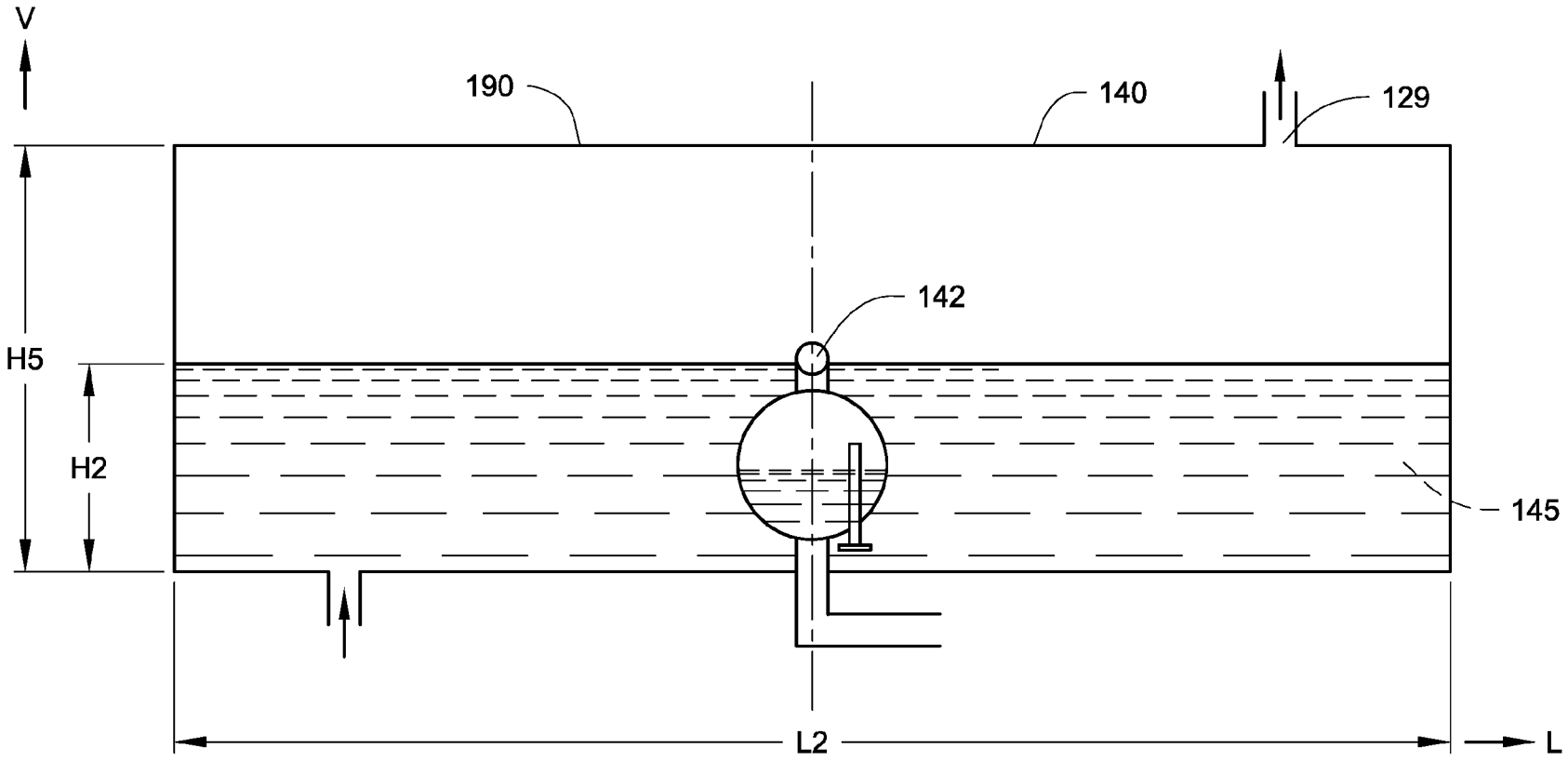

FIGS. 1A and 1B illustrate a HVAC system 100 that includes a compressor 110, a condenser 120, an expansion device 130, an evaporator 140 and refrigerant lines 125 connecting the components of the HVAC systems. The HVAC system further includes a suction line 127 between an outlet 129 of the evaporator 140 and the compressor 110. The suction line 127 is configured to receive lubricating oil returning from the refrigerant line 125 and direct the oil to the compressor 110. The HVAC system 100 also includes a spill over tank 150 having a reservoir 151 configured to be in fluid communication with a spill over port 142 of the evaporator 140 and receive refrigerant spilled over from the spill over port 142.

The refrigerant spilled over from the spill over port 142 may include an oil portion and a refrigerant portion. The spill over tank 150 is equipped with a fluid level sensor 154 configured to measure a refrigerant 159 level inside the spill over tank 150. The spill over tank 150 also has a fluid outlet 158. The fluid outlet 158 can be equipped with a fluid flow regulating device 156 to control a fluid flow rate flowing out of the spill over tank 150, with the appreciation that the fluid flow regulating device 156 may be optional. Some embodiments of the spill over tank 150 may not be equipped with the fluid flow regulating device 156.

The HVAC system 100 includes a controller 160 that can be configured to control the expansion device 130 and/or the fluid flow regulating device 156. The HVAC system 100 can also include a heat exchanger 170 configured to help exchange heat between the refrigerant, which can include the oil portion, flowing out of the spill over tank 150 with a heat source to vaporize the refrigerant portion. In the embodiment as shown in FIG. 1A, the heat source is refrigerant flowing out of the condenser 120 (which generally has a relatively higher temperature). The remaining oil portion may be directed back to the suction line 127 for example in a liquid form.

It is to be noted that the heat exchanger 170 can be configured to receive other heat sources. For example, in some embodiments, the heat exchanger 170 can be configured to receive other process fluids as a heat source, such as cooling water from the condenser 120. In some embodiments, a heating element may be used as a heat source. Generally, a heat source may be used that is configured to have a temperature higher than a temperature required for vaporizing the refrigerant portion of the oil containing refrigerant flowing out of the spill over tank 150.

The evaporator 140 is equipped with a tube bundle 144 that is stacked up from a bottom 146 of the evaporator 140. The evaporator 140 is also charged with refrigerant 145. The refrigerant 145 may include both a refrigerant portion and a lubricating oil portion for the compressor 110. In some embodiments, it is desirable to keep a top 147 of the tube bundle 144 wetted with the refrigerant 145 to maximize heat exchange between a process fluid 148 inside the tube bundle 144 and the refrigerant 145 in the evaporator 140.

The spill over port 142 of the evaporator 140 is positioned at about the top 147 of the tube bundle 144. The spill over tank 150 is generally positioned lower than the spill over port 142 so that the refrigerant spilled out of spill over port 142 of the evaporator 140 can flow into the spill over tank 150, for example, passively by gravity.

In operation, when the top 147 of the tube bundle 144 is wetted with the refrigerant 145, some of the refrigerant 145 may spill out of the spill over port 142. Arrows in FIG. 1A illustrate fluid flow directions of the refrigerant 145 in the HVAC system 100. The refrigerant ($F_{in}$) flowing out of the spill over port 142 into the spill over tank 150 can be collected by the reservoir 151 of the spill over tank 150. The fluid level sensor 154 can measure a spill over refrigerant level H1 inside the spill over tank 150. Values of the spill over refrigerant level H1 may be sent to the controller 160.

The outlet 158 of the spill over tank 150 can be configured to allow the refrigerant 159 collected in the spill over tank 150 to flow out of the spill over tank 150. A fluid flow rate of the refrigerant flowing out ($F_{out}$) of the spill over tank 150 may be affected by the spill over refrigerant level H1 due to, for example, gravity. Generally, the higher the spill over refrigerant level H1 is, the higher the $F_{out}$ may be. The $F_{out}$ may also be optionally regulated by the fluid flow regulating device 156, which may be controlled by the controller 160.

The $F_{out}$, which may include the refrigerant portion and the oil portion, may be directed back to the suction line 127 through the heat exchanger 170 and the refrigerant lines 125. The heat exchanger 170 can be configured to vaporize at least a portion of the refrigerant portion of the $F_{out}$, so that a relatively higher oil concentration may be directed back into the suction line 127 in a liquid form through the refrigerant line 125. By managing $F_{out}$, the oil return to the suction line 127 and the compressor 110 can be managed.

It is to be appreciated that in some embodiments, the spill over tank 150 may not be equipped with the fluid flow regulating device 156, and the $F_{out}$ may depend on the fluid level H1 and gravity. The fluid flow regulating device 156, however, can provide an additional way to regulate the $F_{out}$. For example, by controlling the fluid flow regulating device 156, the controller 160 can be configured to control the $F_{out}$. However, it is to be appreciated that the fluid flow regulating device 156 may not be required to be controlled by the controller 160. For example, as illustrated in FIG. 2B, a metered device may be used as the fluid flow regulating device 156 to meter $F_{out}$ without a control device.

A given $F_{in}$ can result in a corresponding spill over refrigerant level H1 in the spill over tank 150, because the spill over tank 150 is configured to receive the $F_{in}$, and at the same time allow the refrigerant 159 collected in the spill over tank 150 to flow out of the spill over tank 150 through the outlet 158. The $F_{in}$ and the corresponding spill over refrigerant level H1 may be affected by an operational refrigerant level H2 of the refrigerant 145 in the evaporator 140. Generally, raising the operational refrigerant level H2 may correlate with a higher $F_{in}$ and therefore a higher H1, and decreasing the operational refrigerant level H2 may correlate with a lower $F_{in}$ and therefore a lower H1. In some cases, when the operational refrigerant level H2 is sufficiently below the spill over port 142, the $F_{in}$ may be zero.

The operational refrigerant level H2 inside the evaporator 140 can be regulated by the expansion device 130. Generally, opening up the expansion device 130 increases a refrigerant charge to the evaporator 140 thus resulting in a higher operational refrigerant level H2; while closing down the expansion device 130 decreases the refrigerant charge to the evaporator 140 thus resulting in a lower operational refrigerant level H2. The changes in operational refrigerant level H2 can cause corresponding changes in the spill over refrigerant level H1. Therefore, the expansion device 130 can regulate the spill over refrigerant level H1 in the spill over tank 150.

The correlation between the operational refrigerant level H2, the $F_{in}$, the spill over refrigerant level H1 and the $F_{out}$ may allow using the spill over refrigerant level H1 measured by the fluid level sensor 154 to manage the operational refrigerant level H2 in the evaporator 140 and to manage the $F_{out}$ (which is the refrigerant returning to the suction line 127) by controlling the expansion device 130 and/or the fluid flow regulating device 156, for example, by the controller 160.

For example, during operation the operational refrigerant level H2 may need to be maintained at a desired (or a pre-determined) operational level, such as a level that is just sufficient to wet the top 147 of the tube bundle 144, for optimal efficiency of the evaporator 140. The refrigerant 145 at the desired (or pre-determined) operational refrigerant level H2 may spill over from the spill over port 142, causing the $F_{in}$. As a result, the spill over tank 150 can have a corresponding spill over refrigerant level H1 setpoint. If the spill over refrigerant level H1 in the spill over tank 150 is maintained at the spill over refrigerant level H1 setpoint by regulating the expansion device 130, the operational refrigerant level H2 can be maintained at the desired (or pre-determined) operational level. It is understood in the field that during the actual operation, the refrigerant level H2 and/or the spill over refrigerant level H1 may fluctuate during operation. The term "maintain" means that the fluctuation of the refrigerant level H2 and/or the spill over refrigerant level H1 is within, for example, a desired range. For example, the desired range may be a range that the fluctuation of the refrigerant level H2 and/or the spill over refrigerant H1 may not substantially affect the performance of the evaporator 140.

Further, a flow rate of $F_{out}$ can be controlled by controlling the spill over refrigerant level H1 by regulating the expansion device 130 and/or controlling the fluid flow regulating device 156. Increasing the spill over refrigerant level H1 generally leads to a higher $F_{out}$, and decreasing the spill over refrigerant level H1 generally leads to a lower $F_{out}$.

See below for embodiments of methods of controlling the fluid level in the evaporator and the oil return to the compressor. (See FIGS. 3 and 4.)

The position of the spill over port 142 may vary. As illustrated in FIG. 1B, the evaporator 140 has a length L2 in a longitudinal direction L defined by the length L2. In the longitudinal direction, the spill over port 142 is positioned at about a midpoint of the length L2. In a vertical direction defined by a height H5 of the evaporator 140, the spill over port 142 is positioned at a height that is about the same as the refrigerant level H2, which may be a refrigerant level that is just enough to wet the top 147 of the tube bundle 144 (see FIG. 1A).

It is to be noted that the locations of the spill over port 142 may be varied from the location illustrated in FIG. 1B. In some embodiments, the location of the spill over port 142 may be positioned at a place corresponding to where the highest oil concentration is inside the evaporator 140. In some embodiments, the location of the spill over port 142 may be positioned at a place that may be easier to manufacture.

In some embodiments, a head room H4 from the top 147 of the tube bundle 144 to a top 190 of the evaporator 140 may be relatively small. In these embodiments, it is possible that the refrigerant getting into the refrigerant outlet 129 contains liquid refrigerant carry over. It may be desired to locate the spill over port 142 below the top 147 of the tube bundle 144, and keep liquid refrigerant 145 in the evaporator 140 away from the refrigerant outlet 129 to help reduce liquid refrigerant carry over.

It is appreciated that the embodiments as described herein may be used with either a flooded evaporator design or a falling-film evaporator design. It can also be adapted to be used with any other evaporators having a pool section that can benefit from a refrigerant level control. The embodiments as described herein may also be adapted to be used with any other types of liquid and any apparatus with a pool section that can benefit from a liquid level control in the pool section. For example, the embodiments as described herein can be adapted to maintain a desired fluid level in the pool section of an apparatus.

It is also to be appreciated that in some embodiments, a flow rate meter instead of the spill over tank may be used. The operational refrigerant level H2 may result in a corresponding flow rate of the $F_{in}$. Changes in the operational refrigerant level H2 may cause corresponding changes in the flow rate of the $F_{in}$. Therefore, an association may be established between the flow rate of the $F_{in}$ and the operational refrigerant level H2 in the evaporator 140. By measuring the flow rate of the $F_{in}$, for example, by the flow rate meter, the operational refrigerant level H2 in the evaporator 140 may be obtained based on the association between the flow rate of the $F_{in}$ and the fluid level H2 in the evaporator 140. Accordingly, the operational refrigerant level H2 can be changed or maintained by regulating the refrigerant charge to the evaporator 140 based on the flow rate of the $F_{in}$. As discussed for FIG. 1A, the spill over refrigerant level H1 in the spill over tank 150 is correlated to the $F_{in}$. Therefore, the spill over tank 150 equipped with the fluid level sensor 154 can be considered as an embodiment of a flow rate meter in a broad sense.

Generally, the refrigerant charge to the evaporator 140 may be controlled by a flow regulation device, such as the expansion device 130 as illustrated in FIG. 1. However, it is to be appreciated that other methods and/or devices may be implemented to control the refrigerant charge to the evaporator 140.

It is noted that in some embodiments, the flow regulation device 156 can be a device that is configured to be controlled by the controller 160. In some embodiments, the flow regulation device 156 may not be controlled by the controller 160. For example, the flow regulation device 156 may be a passive metering device, such as a standpipe 256*b* as described below in FIG. 2B, and the flow rate through the flow regulation device 156 may be regulated by changing the fluid level in the spill over tank 150.

In some embodiments, the spill over refrigerant level H1 in the spill over tank 150 may be configured to be at about a half point of a total height H3 of the fluid level sensor 154, when the refrigerant level H2 in the evaporator is at about the desired level in operation, for example, when the refrigerant level H2 in the evaporator 140 is just enough to wet the top 147 of the tube bundle 144. This configuration may help the fluid level sensor 154 have good sensitivity to measure both increase and decrease of the spill over refrigerant level H1 in the spill over tank 150.

It is to be appreciated that the embodiments as described herein are exemplary. The HVAC system can have different configurations. Some HVAC systems may be configured to have an oil sump or an oil tank that is positioned upstream or downstream of the compressor and is configured to store oil. The $F_{out}$ may be directed to, for example, the oil tank or oil sump before being directed to the compressor 110.

Figure 2A:
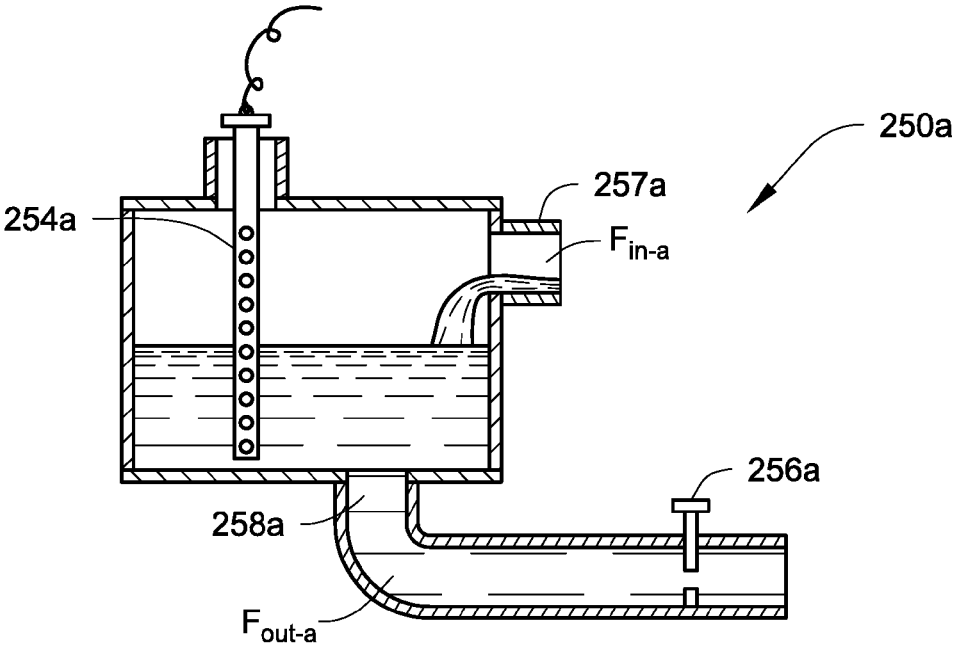
FIGS. 2A and 2B illustrate two embodiments of spill over tanks.
Figure 2B:
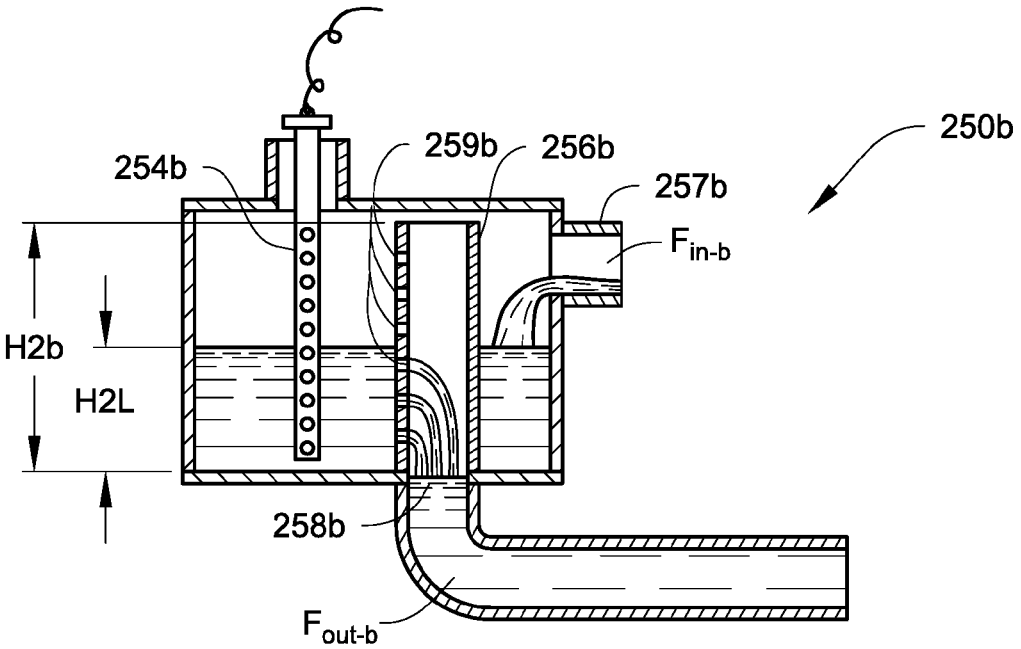

FIGS. 2A and 2B illustrate two embodiments of spill over tanks 250*a* and 250*b* respectively. As illustrated, both of the spill over tanks 250*a* and 250*b* include spill over tank inlets 257*a* and 257*b* respectively, which are configured to receive fluid $F_{in}$-a and $F_{in}$-b from an evaporator (such as the evaporator 140 in FIG. 1A). The spill over tanks 250*a* and 250*b* also include fluid level sensors 254*a* and 254*b*.

The spill over tank 250*a* includes a fluid control valve 256*a* as a fluid flow regulating/metering device (e.g. the fluid flow regulating device 156 in FIG. 1A) configured to control the fluid flowing out of an outlet 258*a* of the spill over tank 250*a* ($F_{out}$-a). The fluid control valve 256*a* may be configured to be manually controlled, or to be controlled, for example, by a controller (e.g. the controller 160 in FIG. 1A).

The spill over tank 250*b* includes a standpipe 256*b* as a fluid flow regulating/metering device (e.g. the fluid flow regulating device 156 in FIG. 1A) configured to control the fluid flowing out of an outlet 258*b* of the spill over tank 250*b* ($F_{out}$-b) in a metered manner. The standpipe 256*b* is positioned upstream of the outlet 258*b* and is orientated in about a vertical direction defined by a fluid level height H2L of the spill over tank 250*b*. The standpipe 256*b* includes a plurality of openings 259*b* distributed at different heights along a height H2*b* of the standpipe 256*b*. The openings 259*b* are configured to meter the fluid flowing downstream to the outlet 258*b*. Generally, when the fluid level height H2L increases, more openings 259*b* are below the fluid level height H2L, causing a higher $F_{out}$-b.

It is to be appreciated that the size of the openings 256*b* and locations of the openings 256*b* along the vertical direction defined by the fluid level height H2L can be varied. Generally, large openings 256*b* and more openings 256*b* along the vertical direction defined by the fluid level height H2L may lead to a higher $F_{out}$-b. It is also to be appreciated that the size of the opening 259*b* and the locations of the openings 259*b* along the vertical direction defined by the fluid level height H2L can be configured to meter a specific range of $F_{out}$-b to meet needs of, for example, a specific HVAC system design. It is also to be appreciated that the sizes of the openings can vary along the vertical direction defined by the fluid level height H2L; and a distribution of the openings 259*b*, and/or a distance between two neighboring openings 259*b*, may vary along the vertical direction defined by the fluid level height H2L. By varying the sizes and/or the distributions of the openings 259*b*, it is possible to provide a specific association between the height H2L and the metered rate of the $F_{out}$-b.

As discussed above, the spill over tank, such as the spill over tanks 150, 250*a* and 250*b* as illustrated in FIGS. 1A, 1B, and FIGS. 2A, 2B, can be used to manage a fluid in a HVAC system, including a refrigerant level inside an evaporator and an oil return to a compressor.

Figure 3:
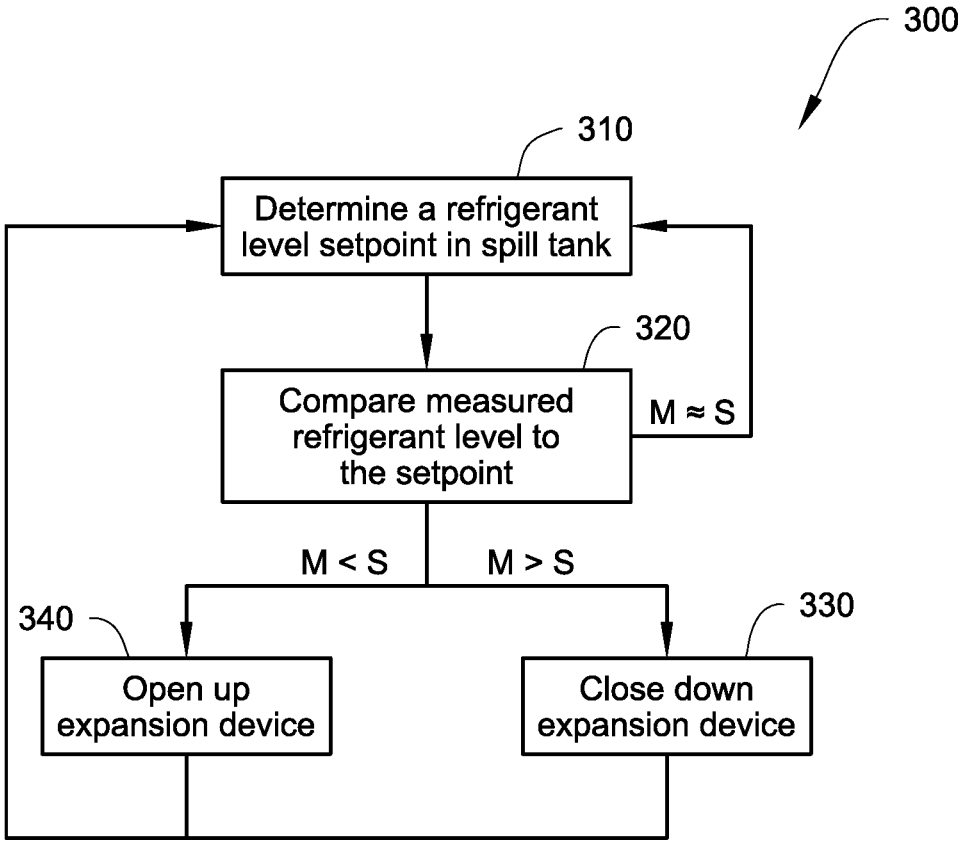
FIG. 3 illustrates a method to manage a refrigerant level in an evaporator of a HVAC system.
Figure 4:
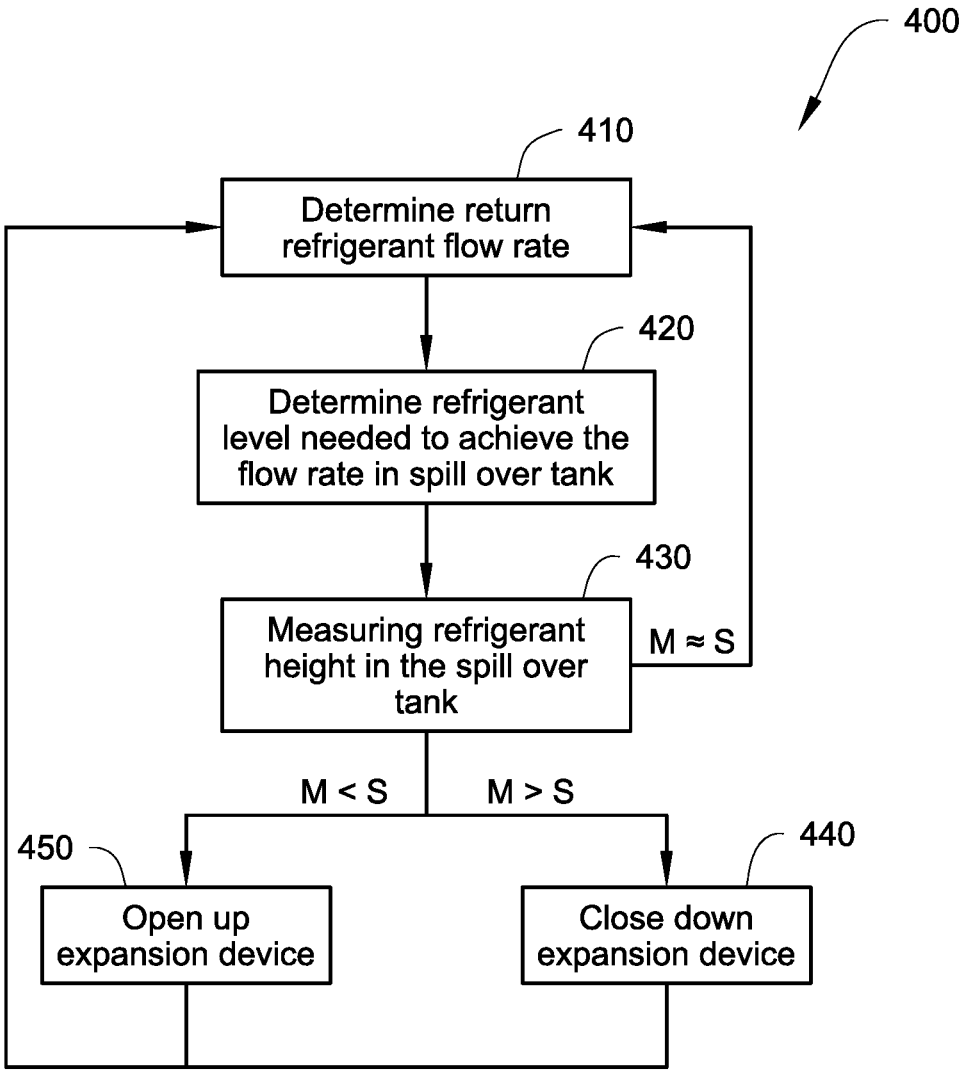
FIG. 4 illustrates a method to manage oil return to a compressor of a HVAC system.

FIGS. 3 and 4 illustrate embodiments of methods 300, 400 of fluid management in a HVAC system respectively. It is noted that the methods 300 and 400 may be executed by a controller of the HVAC system, such as the controller 160 as illustrated in FIG. 1A.

Referring to FIG. 3, the method 300 to manage a refrigerant level in an evaporator (such as the evaporator 140 in FIG. 1A) is illustrated.

At 310, a spill over refrigerant level setpoint in a spill over tank (such as the spill over tank 150 in FIG. 1A) is determined. An operational refrigerant level (e.g. H2 in FIG. 1A) inside the evaporator correlates with the spill over refrigerant level (e.g. H1 in FIG. 1A) in the spill over tank. Generally, the higher the operational refrigerant level in the evaporator is, the higher the spill over refrigerant level in the spill over tank. Therefore, an association between the operational refrigerant level in the evaporator and the corresponding spill over refrigerant level in the spill over tank can be established, for example, in a laboratory setting. The spill over refrigerant level setpoint in the spill over tank corresponding to a desired operational refrigerant level in the evaporator therefore can be determined based on the association between the operational refrigerant level in the evaporator and the spill over refrigerant level in the spill over tank.

For example, in some embodiments, a desired operational refrigerant level inside the evaporator may be a level that is just sufficient to fully wet the tube bundle (e.g. the tube bundle 144 in FIG. 1A) by the refrigerant (the refrigerant 145 in FIG. 1A) inside the evaporator. The desired operational refrigerant level can be associated with a corresponding spill over refrigerant level in the spill over tank. The spill over refrigerant level in the spill over tank associated with the desired operational refrigerant level inside the evaporator can be used as the spill over refrigerant level setpoint (S in FIG. 3) at 310.

At 320, a spill over refrigerant level inside the spill over tank is measured by a fluid level sensor (such as the fluid level sensor 154 in FIG. 1A). The spill over refrigerant level (M in FIG. 3) is compared to the spill over refrigerant level setpoint determined at 310. This comparison can be performed by a controller (such as the controller 160 in FIG. 1A).

If the spill over fluid level is higher than the spill over refrigerant level setpoint (M>S), which indicates that the operational refrigerant level inside the evaporator is higher than the desired operational refrigerant level, the method proceeds to 330. At 330, an expansion device (such as the expansion device 130 in FIG. 1A) is configured to be closed down by, for example, the controller, to reduce a refrigerant charge to the evaporator so as to reduce the operational refrigerant level in the evaporator. The method 300 then proceeds back to 310 to monitor whether a new setpoint is determined or whether the operational refrigerant level reaches the spill over refrigerant setpoint.

If the spill over refrigerant level is lower than the spill over refrigerant level setpoint (M<S), which indicates that the operational refrigerant level inside the evaporator is lower than the desired operational refrigerant level, the method proceeds to 340. At 340, an expansion device (such as the expansion device 130 in FIG. 1A) is configured to be opened up by, for example, the controller, to increase the refrigerant charge to the evaporator so as to increase the operational refrigerant level in the evaporator. The method 300 then proceeds back to 310 to monitor whether a new setpoint is determined or whether the operational refrigerant level reaches the spill over refrigerant setpoint.

If the spill over refrigerant level is about the same as the spill over refrigerant level setpoint, which indicates that the operational refrigerant level inside the evaporator is at about the desired operational refrigerant level, the method 300 proceeds back to 310 to monitor whether a new setpoint is determined, or the refrigerant charge to the evaporator is maintained.

The method 300 can be used to maintain a desired refrigerant level inside an evaporator. Because a size of the spill over tank is relatively small compared to the evaporator, relatively small changes in the refrigerant level in the evaporator may cause relatively large changes in the spill over tank. Therefore, the spill over refrigerant level changes in the spill over tank can amplify the refrigerant level changes in the evaporator. Accordingly, monitoring the refrigerant level in the spill over tank can help maintain the refrigerant level in the evaporator more precisely compared to not using the spill over tank. This can help increase the efficiency of the evaporator in various operation conditions of the HVAC system. In some embodiments, a relatively less sensitive fluid level sensor inside the spill over tank may be sufficient for the purpose of maintaining the refrigerant level in the evaporator compared to a fluid level sensor positioned inside the evaporator, which can help save the manufacturing cost.

In an oil return management mode 400 as illustrated in FIG. 4, a return refrigerant flow rate is determined at 410.

The return refrigerant flow is the refrigerant flowing out of the spill over tank (e.g. $F_{out}$ in FIG. 1A). The refrigerant flowing out of the evaporator may contain a refrigerant portion and an oil portion. As illustrated in FIG. 1A, the $F_{out}$ may be directed into a heat exchanger (such as the heat exchanger 170 in FIG. 1A) to vaporize at least a portion of the refrigerant portion of the $F_{out}$ before the $F_{out}$ being directed back into suction line, which helps supply oil to a compressor (such as the suction line 127 and the compressor 110 in FIG. 1A). The oil portion is typically directed back in a liquid form. Accordingly, controlling the $F_{out}$ may affect the oil return to the compressor.

At 410, a desired refrigerant return rate can be determined based on, for example, an oil return requirement of the compressor. The oil return requirement of the compressor may be, for example, affected by operation conditions of the compressor and the HVAC system. In some embodiments, the oil return requirement may be determined to ensure proper lubrication of the compressor to help for example reduce compressor wear. In some embodiments, the oil return requirement may be determined to ensure for example proper oil content in the refrigerant inside the evaporator to help an efficiency of the evaporator.

At 420, the return refrigerant flow rate determined at 410 is used to determine, for example, a refrigerant level height (such as the fluid level height H2L in FIG. 2B) required to achieve the metered return refrigerant flow rate. As illustrated in FIG. 2B, for example, a higher fluid level height H2L correlates generally to more openings 259*b* used to direct the fluid out of the spill over tank 250*b*, and therefore correlates to a higher metered $F_{out}$-b. Conversely, a lower fluid level height H2L correlates to less openings 259*b* used to direct the fluid out of the spill over tank 250*b*, and therefore correlates to a lower metered $F_{out}$-b. For the spill over port with a standpipe, such as the standpipe 256*b* as illustrated in FIG. 2B, an association can be established between the fluid level height H2L and the metered return refrigerant flow rate (e.g. $F_{out}$-b in FIG. 2B). Accordingly, the proper refrigerant level height setpoint in the spill over tank to achieve the return refrigerant flow rate determined at 410 can be determined at 420.

At 430, the spill over refrigerant level height in the spill over tank is measured by a fluid level sensor (e.g. the fluid level sensor 154 in FIG. 1A). The spill over refrigerant level height (M in FIG. 4) is compared to the refrigerant level height setpoint (S in FIG. 4) determined at 420.

If the spill over refrigerant level height in the spill over tank is higher than the refrigerant level height setpoint (M>S), which indicates that the metered return refrigerant rate is higher than the desired refrigerant return rate, the method proceeds to 440. At 440, an expansion device (such as the expansion device 130 in FIG. 1A) is configured to be closed down by, for example, a controller (e.g. the controller 160 in FIG. 1A), to reduce a refrigerant charge to the evaporator so as to reduce the operational refrigerant level in the evaporator and the spill over tank. The methods 400 then proceeds back to 410 to monitor whether a new return refrigerant flow rate is determined or whether the refrigerant level height setpoint has been reached.

If the spill over refrigerant level height in the spill over tank is lower than the fluid level height setpoint (M<S), which indicates that the metered return refrigerant rate is lower than the desired refrigerant return rate, the method proceeds to 450. At 450, an expansion device (such as the expansion device 130 in FIG. 1A) is configured to be opened up, for example, by the controller, to increase the refrigerant charge to the evaporator so as to increase the fluid level in the evaporator and in the spill over tank. The methods 400 then proceeds back to 410 to monitor whether a new return refrigerant flow rate is determined or whether the refrigerant level height setpoint has been reached.

If the spill over refrigerant level height is about the same as the refrigerant level height setpoint, which indicates that the metered return refrigerant rate is at about the desired refrigerant return rate, the method 400 proceeds to 410 to monitor whether a new setpoint is determined or the fluid charge to the evaporator is maintained.

The method 400 can be used to manage oil return to the compressor, which may help maintain proper lubrication to the compressor, and/or maintain a desired efficiency of the evaporator. The method 400 can also help the evaporator maintain an acceptable oil concentration in the refrigerant inside the evaporator.

It is to be appreciated that the embodiments disclosed in FIGS. 3 and 4 are exemplary. Other methods can be adopted to use the fluid level measurement in the spill over tank by the fluid level sensor to manage a fluid in the HVAC system.

Further, when a control valve, such as the control valve 256*a* as illustrated in FIG. 2A, is used, the control valve may be controlled by the controller (e.g. the controller 160 in FIG. 1A) along with the expansion device to manage the refrigerant level in the evaporator and the refrigerant return to the compressor.

Embodiments described herein are directed to fluid management in an evaporator and/or a compressor by using the fluid levels measured in a spill over tank. Because the spill over tank receives the fluid from the evaporator, and at the same time allows the fluid received in the spill over tank to flow out of the spill over tank, a certain operational refrigerant level in the evaporator may result in a corresponding spill over refrigerant level in the spill over tank. Since changes in the operational refrigerant level can cause corresponding changes in the spill over refrigerant level in the spill over tank. An association can be established between the operational refrigerant level in the evaporator and the spill over refrigerant level in the spill over tank.

Because relatively small changes of the refrigerant level in the evaporator can cause relatively large changes of the refrigerant level in the spill over tank, the embodiments described herein may help maintain a desired refrigerant level in the evaporator more precisely. The embodiments described herein may also help maintain a balance between the refrigerant leaving the evaporator (e.g. from the refrigerant outlet 129 of the evaporator 140 and/or from the spill over port 142 in FIG. 1) and the refrigerant entering the evaporator through the expansion device (e.g. the expansion device 130 in FIG. 1). The embodiments described herein may also help manage oil return to the suction line, so that the compressor can be properly lubricated, and/or the oil content in the evaporator may be proper.

It is to be appreciated that a general principle may include directing a portion of refrigerant (e.g. $F_{in}$ in FIG. 1A), or other liquid, out of an evaporator (or other liquid containing apparatus). A flow rate of the refrigerant directed out of the evaporator may be configured to have an association with a refrigerant level in the evaporator. For example, the higher the refrigerant level in the evaporator is, the higher the flow rate. Therefore, the flow rate of the refrigerant directed out of the evaporator may be used to control a refrigerant charge to the evaporator so as to maintain the refrigerant level in the evaporator. If the flow rate is maintained, the operational refrigerant level in the evaporator may be maintained at an operational refrigerant level corresponding to the flow rate.

The flow rate may also be used to regulate the operational refrigerant level in the evaporator. To increase the operational refrigerant level to a new level in the evaporator, the expansion device can be opened up to increase the refrigerant charge to the evaporator until the flow rate reaches a new flow rate corresponding to the new operational refrigerant level in the evaporator. To decrease the operational refrigerant level to a new level in the evaporator, the expansion device can be closed down to reduce the refrigerant charge to the evaporator until the flow rate reaches a new flow rate corresponding to the new operational refrigerant level in the evaporator.

Alternatively, the refrigerant charge into the evaporator can be controlled, for example, by opening up or closing down the expansion device 130 to achieve a desired return refrigerant flow rate to the compressor. The return refrigerant flow rate is generally the flow rate measured by the flow rate meter. Generally, increasing the refrigerant charge to the evaporator can increase the return refrigerant flow rate to the compressor; and decreasing the refrigerant charge to the evaporator can decrease the return refrigerant flow rate to the compressor.

Along with this general principle as described above, measuring a spill over refrigerant level in a spill over tank, such as the spill over tank 150 as described in FIG. 1A, may be considered as a way to measure the flow rate of the refrigerant directed out of the evaporator. Generally, a higher spill over refrigerant level in the spill over tank is associated with the increased refrigerant flow rate directed out of the evaporator; a lower spill over refrigerant level in the spill over tank is associated with a decreased refrigerant flow rate directed out of the evaporator. Accordingly, the spill over refrigerant level in the spill over tank may be associated with the flow rate of the refrigerant directed out of the evaporator.

The spill over tank may be configured to be smaller than the evaporator. Therefore, the changes in the refrigerant level in the evaporator can be amplified as the changes in the refrigerant level the spill over tank, which help control the refrigerant level in the evaporator more precisely. Further, this may also help control the refrigerant return rate more precisely.

It is to be appreciated that the embodiments and principles described herein may be adapted to use with any other fluid containing apparatus.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. A spill over tank for an evaporator of a heating, ventilation, and air conditioning (HVAC) system, comprising:

a reservoir fluidly connected to the evaporator and configured to receive refrigerant from the evaporator; and a fluid level sensor disposed inside the reservoir and configured to measure a refrigerant level in the reservoir, the refrigerant level in the reservoir indicating an operational refrigerant level in the evaporator, wherein the reservoir is externally connected to the evaporator of the HVAC system.

2. The spill over tank of claim 1, wherein the reservoir is configured to direct refrigerant to a heat exchanger that receives a heat source and that exchanges heat between the heat source and the refrigerant directed into the heat exchanger.

3. The spill over tank of claim 1, further comprising:

a fluid flow regulating device configured to regulate a refrigerant flow flowing out of the reservoir.

4. The spill over tank of claim 3, wherein the fluid flow regulating device is a flow control valve.

5. The spill over tank of claim 3, wherein the fluid flow regulating device is a standpipe, the standpipe has a plurality of openings along a height of the standpipe, and the openings are configured to meter the refrigerant flow.

6. A heating, ventilation, and air conditioning (HVAC) system, comprising:

an evaporator including a shell and a spill over port; and a spill over tank including a reservoir and a fluid level sensor disposed inside the reservoir, the reservoir being externally connected to the evaporator in the HVAC system, wherein the spill over port is positioned at a side of the shell of the evaporator, the spill over port being configured to direct refrigerant from the shell of the evaporator to the reservoir, the fluid level sensor is configured to measure a refrigerant level in the spill over tank, and the refrigerant level in the spill over tank indicates an operational refrigerant level in the evaporator.

7. The HVAC system of claim 6, further comprising:

a tube bundle inside the shell of the evaporator, wherein the tube bundle has a top, and the spill over port is positioned about the top of the tube bundle.

8. The HVAC system of claim 6, further comprising:

a heat exchanger configured to receive a heat source, wherein the spill over tank is coupled to the heat exchanger.

9. The HVAC system of claim 6, further comprising:

a fluid flow regulating device, wherein the fluid flow regulating device is configured to regulate the refrigerant flowing out of the reservoir.

10. The HVAC system of claim 9, wherein the fluid flow regulating device is a flow control valve.

11. The HVAC system of claim 9, wherein the fluid flow regulating device is a standpipe, the standpipe has a plurality of openings along a height of the standpipe, and the openings are configured to meter the refrigerant flowing out of the reservoir.

12. A method of maintaining a fluid level in the evaporator in the HVAC system of claim 6, comprising:

determining a spill over refrigerant level setpoint for the spill over tank based on a desired operational refrigerant level in the evaporator and a corresponding spill over refrigerant level in the spill over tank;

measuring the spill over refrigerant level in the spill over tank; and comparing the spill over refrigerant level in the spill over tank with the spill over refrigerant level setpoint;

when the spill over refrigerant level in the spill over tank is higher than the spill over refrigerant level setpoint, decreasing a refrigerant charge to the evaporator;

when the spill over refrigerant level in the spill over tank is lower than the spill over refrigerant level setpoint, increasing the refrigerant charge to the evaporator; and when the spill over refrigerant level in the spill over tank is the same as the refrigerant level setpoint, maintaining the refrigerant charge to the evaporator.

13. A method of regulating a return fluid flow to a compressor in the HVAC system of claim 6, comprising:

determining a return refrigerant flow to the compressor;

determining a refrigerant level inside the spill over tank to achieve the return refrigerant flow;

measuring a refrigerant level in the spill over tank; and comparing the measured refrigerant level in the spill over tank with the determined refrigerant level;

when the measured refrigerant level in the spill over tank is lower than the determined refrigerant level, increasing a refrigerant charge to the evaporator;

when the measured refrigerant level in the spill over tank is higher than the determined refrigerant level, decreasing the refrigerant charge to the evaporator; and when the measured refrigerant level in the spill over tank is the same as the determined refrigerant level, maintaining the refrigerant charge to the evaporator.

14. A method of managing a fluid in a heating, ventilation, and air conditioning (HVAC) system, comprising:

directing a portion of refrigerant out of an evaporator to a spill over tank externally connected to the evaporator in the HVAC system, wherein a flow rate of the refrigerant directed out of the evaporator to the spill over tank has an association with a refrigerant level in the evaporator;

measuring the flow rate of the refrigerant directed out of the evaporator to the spill over tank; and comparing the flow rate of the refrigerant directed out of the evaporator to the spill over tank with a flow rate setpoint, when the flow rate is lower than the flow rate setpoint, increasing a refrigerant charge to the evaporator, when the flow rate is higher than the flow rate setpoint, decreasing the refrigerant charge to the evaporator, and when the flow rate is the same as the flow rate setpoint, maintaining the refrigerant charge to the evaporator.

15. The method of claim 14, further comprising:

determining a desired operational refrigerant level in the evaporator;

determining a desired flow rate setpoint associated with the desired operational refrigerant level in the evaporator based on the association between the flow rate and the operational refrigerant level in the evaporator; and setting the flow rate setpoint to the desired flow rate setpoint.

16. The method of claim 14, further comprising:

determining a desired flow rate setpoint based on a requirement of a compressor of the HVAC system; and setting the flow rate setpoint to the desired flow rate setpoint.

17. The method of claim 14, wherein measuring the flow rate of the refrigerant directed out of the evaporator to the spill over tank includes:

collecting the refrigerant directed out of the evaporator in the spill over tank;

measuring a refrigerant level of the refrigerant collected in the spill over tank; and directing the refrigerant collected in the spill over tank out of the spill over tank.

* * * * *